US005299898A

United States Patent [19]

Kaufmann et al.

[11] Patent Number: 5,299,898

[45] Date of Patent: Apr. 5, 1994

[54] METHOD OF AND APPARATUS FOR BINDING STACKS OF SUPERIMPOSED SHEETS

[75] Inventors: Rudolf Kaufmann, Neuffen; Jürgen Scholz, Oberboihingen, both of Fed. Rep. of Germany

[73] Assignee: Womako Maschinenkonstruktionen GmbH, Nurtingen, Fed. Rep. of Germany

[21] Appl. No.: 64,710

[22] Filed: May 19, 1993

[30] Foreign Application Priority Data

Jun. 17, 1992 [DE] Fed. Rep. of Germany ..... 4219792

[51] Int. Cl.[5] ..... B42B 5/08

[52] U.S. Cl. ..... 412/7; 281/21.1; 402/501; 412/33; 412/42

[58] Field of Search ..... 281/15.1, 21.1; 402/501; 412/6, 7, 33, 38, 42, 43

[56] References Cited

U.S. PATENT DOCUMENTS

| | | | |
|---|---|---|---|
| 4,313,703 | 2/1982 | Fabrig | 414/115 |
| 4,662,816 | 5/1987 | Fabrig | 414/786 |
| 5,015,114 | 5/1991 | Miller | 402/501 X |

FOREIGN PATENT DOCUMENTS

| | | | |
|---|---|---|---|
| 1019995 | 11/1957 | Fed. Rep. of Germany | 402/501 |
| 733692 | 10/1932 | France | 402/501 |
| 485477 | 5/1938 | United Kingdom | 402/501 |
| 667716 | 3/1952 | United Kingdom | 412/42 |

*Primary Examiner*—Paul A. Bell
*Attorney, Agent, or Firm*—Darby & Darby

[57] ABSTRACT

Successive stacks of overlapping paper sheets are delivered by tongs to an assembling station where the sheets of successive stacks are connected to each other by circular binders including rims having a T-shaped or an L-shaped cross-sectional outline and being receivable in T-shaped or L-shaped marginal recesses of the sheets. The binders are delivered into and are held in the form of a row in equidistant sockets provided in part in stationary and in part in movable supports at the assembling station. Portions of sheets of a stack at the assembling station are deformed against the adjacent binders to thus introduce the binders into discrete recesses of each sheet, and the thus obtained stationery products are removed from the assembling station longitudinally of the row of sockets.

30 Claims, 4 Drawing Sheets

METHOD OF AND APPARATUS FOR BINDING STACKS OF SUPERIMPOSED SHEETS

BACKGROUND OF THE INVENTION

The invention relates to improvements in methods of and in apparatus for making steno pads, other types of pads and/or analogous stationery products from stacks of overlapping sheets which are held together by rows of binders having portions extending into a series of recesses or cutouts provided in marginal portions of the sheets.

It is known to hold the sheets of a stack of overlapping sheets together by ring-shaped binders which can be opened up to enable the arcuate end portions of the opened binders to enter circular holes provided in one marginal portion of each sheet. The binders are thereupon closed to thus prevent accidental extraction of one or more sheets. The situation is different when the sheets of a stack of overlapping sheets are to be held together along one of their marginal portions by binders which are not designed to be opened, e.g., by binders which resemble circular discs and comprise rims having a substantially T-shaped cross-sectional outline. The sheets of stacks wherein the sheets are to be held together by such binders must be provided with recesses or cutouts each of which is open toward the adjacent marginal portion of the sheets so that the rim of a binder can be introduced into the recess without tearing of the sheet.

OBJECTS OF THE INVENTION

An object of the invention is to provide a method of assembling the sheets of successive stacks of overlapping sheets by resorting to simple and inexpensive plastic, metallic or other binders which need not be opened up for the purpose of entering the recesses in marginal portions of the sheets.

Another object of the invention is to provide a method of joining the overlapping sheets of a stack to each other by one-piece binders with portions designed to fill or substantially fill complementary recesses or cutouts in the sheets.

A further object of the invention is to provide a method which renders it possible to movably connect the sheets of a stack of overlapping sheets to each other with little loss of time and without permanent deformation of the sheets.

An additional object of the invention is to provide novel and improved stationery products by resorting to a method of the above outlined character.

Still another object of the invention is to provide a novel and improved apparatus for the practice of the above outlined method.

A further object of the invention is to provide the apparatus with novel and improved means for manipulating the binders.

Another object of the invention is to provide the apparatus with novel and improved means for breaking up and otherwise manipulating stacks of sheets preparatory to and during connection with discrete circular binders.

An additional object of the invention is to provide the apparatus with novel and improved means for delivering binders and sheets to and for removing finished stationery or like products from an assembling station.

Still another object of the invention is to automate the making of stationery products and to provide a method and apparatus for mass production of such products at a reasonable cost and in a space saving manner.

SUMMARY OF THE INVENTION

One feature of the present invention resides in the provision of a method of assembling stacks of overlapping paper sheets or the like, each of which has a plurality of marginal recesses and deformable sheet portions at the recesses, with plastic, metallic or other binders having profiles which are at least substantially complementary to and are receivable in the recesses of a stack of sheets. The improved method comprises the steps of positioning a series of spaced apart and aligned binders at an assembling station, and moving the deformable sheet portions against the thus positioned binders so that each binder deforms a discrete portion of each sheet and enters the respective recess.

The moving step can include advancing the deformable portions of successive sheets of a stack of overlapping sheets from a higher level above to a lower level of engagement with the binders at the assembling station.

The positioning step preferably includes force- and form-lockingly holding the spaced apart and aligned binders at the assembling station in the course of the moving step. Such method preferably further comprises the steps of connecting the binders of the series with at least one panel (such as the front or back cover of a hook, note book, memo pad, pamphlet or the like) to thus locate the binders in a row at predetermined distances from each other, and thereupon advancing the at least one panel and the row of binders thereon to the assembling station.

The method can also comprise the steps of providing the overlapping sheets of the stacks with substantially T-shaped recesses and providing each binder with a substantially circular rim having a substantially T-shaped cross-sectional outline.

Still further, the method can comprise the steps of locating a stack of overlapping sheets adjacent the assembling station and subdividing the thus located stack into a succession of smaller stacks each of which contains at least one sheet. The moving step of such method can include transferring the deformable sheet portions of successive smaller stacks of the succession of smaller stacks against the positioned binders at the assembling station. The locating step of such method can comprise maintaining the stack of overlapping sheets above the assembling station, and the transferring step of such method preferably comprises shifting the deformable sheet portions of successive smaller stacks of the succession of smaller stacks downwardly against the positioned binders at the assembling station. Still further, such method can comprise the step of lowering the positioned binders upon completion of at least one of the shifting steps. The lowering step can comprise lowering the binders and the entire smaller stack or stacks which was or which were shifted upon completion of the at least one shifting step.

The method can also comprise the step of raising the positioned binders at the assembling station upon completed transfer of at least one smaller stack of the succession of smaller stacks.

As mentioned above, the method can comprise the step of connecting the binders of the series of binders with at least one panel to thus locate the binders in a row, preferably a straight elongated row at predetermined distances from each other, and the aforementioned advancing step of such method preferably comprises thereupon advancing the at least one panel to the assembling station in the longitudinal direction of the straight elongated row of binders.

The sheets of each stack preferably have spaced parallel first and second marginal zones with recesses provided in the first marginal zones. The method which is used to manipulate such stacks can further comprise the step of delivering a series of stacks to the assembling station including conveying the stacks substantially at right angles to the marginal zones of the respective stacks. Such method preferably further comprises the step of clamping the second marginal zones of successive stacks of the series of stacks in the course of the conveying and moving steps.

Another feature of the present invention resides in the provision of an apparatus for assembling stacks of overlapping sheets, each of which has a plurality of marginal recesses and deformable sheet portions at the recesses, with binders having profiles substantially complementary to and receivable in the recesses. The improved apparatus comprises means for positioning a series of spaced apart and aligned binders at an assembling station, and means for moving the deformable sheet portions of a stack of overlapping sheets against the positioned binders at the assembling station so that each binder deforms a discrete portion of each sheet and enters the respective recess.

The positioning means can comprise a row of spaced apart positioning units at the assembling station, and the moving means of such apparatus can comprise a plurality of deforming units each of which is adjacent one of the positioning units. The deforming units alternate with the positioning units.

The moving means of the improved apparatus can comprise an elongated carrier and a plurality of deforming elements which are provided on the carrier. The deforming elements have sheet engaging portions, and the moving means of such apparatus further comprises means for orbiting the sheet engaging portions along endless paths.

If the stacks are to be assembled with substantially circular binders, the positioning means can include a row of sockets for discrete binders, a stop for the binders in the sockets, and means for biasing the binders in the sockets against the stop. The positioning means of such apparatus preferably further comprises a stationary first support and a mobile second support at the assembling station. Each socket has a first portion in the first support and a second portion in the second support. Such apparatus can further comprise means for moving the second support relative to the first support through increments of predetermined length. Each row of binders can be connected with at least one panel (such as the front cover or the rear cover of a book, memo pad or the like). The first support of the positioning means in such apparatus is provided with means for locating the at least one panel at the assembling station while the binders of the respective row are disposed in the sockets. The stop is located between the first and second supports, and the apparatus can further comprise means for moving the stop relative to the first support. The sockets are preferably disposed above the stop, and the means for moving the stop can include means for moving the stop up and down.

The apparatus is preferably further provided with means for breaking up successive stacks of a series of stacks into a succession of smaller stacks at the assembling station. Such means for breaking up can include means for delivering successive smaller stacks of each succession of smaller stacks to the moving means. The delivering means can comprise a holder for discrete smaller stacks and means for moving the holder along an endless path between a first position in which the holder accepts a smaller stack and a second position in which the holder presents the smaller stack to the moving means. The means for breaking up successive stacks can further comprise a subdividing tool (such as a sword) and means for moving the tool into a stack at the assembling station to separate a smaller stack.

The means for breaking up successive stacks preferably further comprises a device (e.g., in the form of tongs) for supplying successive stacks to the assembling station, a platform which is located at the assembling station to support from below a stack which is supplied by the tongs, and means for changing the orientation of (namely for tilting) the platform relative to the tongs.

The positioning means of the improved apparatus can comprise means for delivering elongated row of binders to the assembling station longitudinally of the rows of binders. Such delivering means can further serve as a means for removing finished products (e.g., memo pads) from the assembling station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
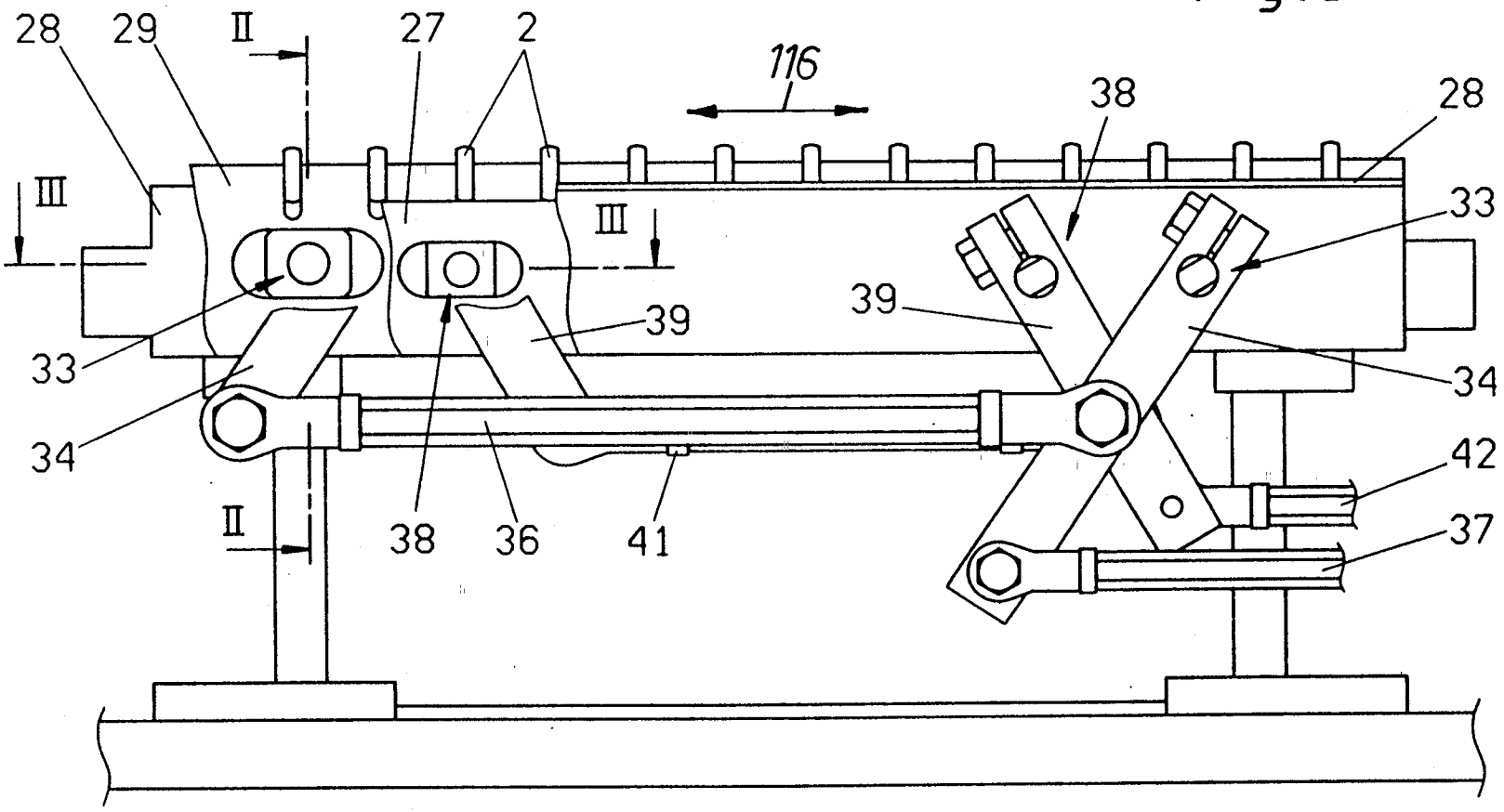
FIG. 1 is a front elevational view of the lower part of an apparatus which is designed for the making of stationery products in accordance with the improved method.
Figure 2:
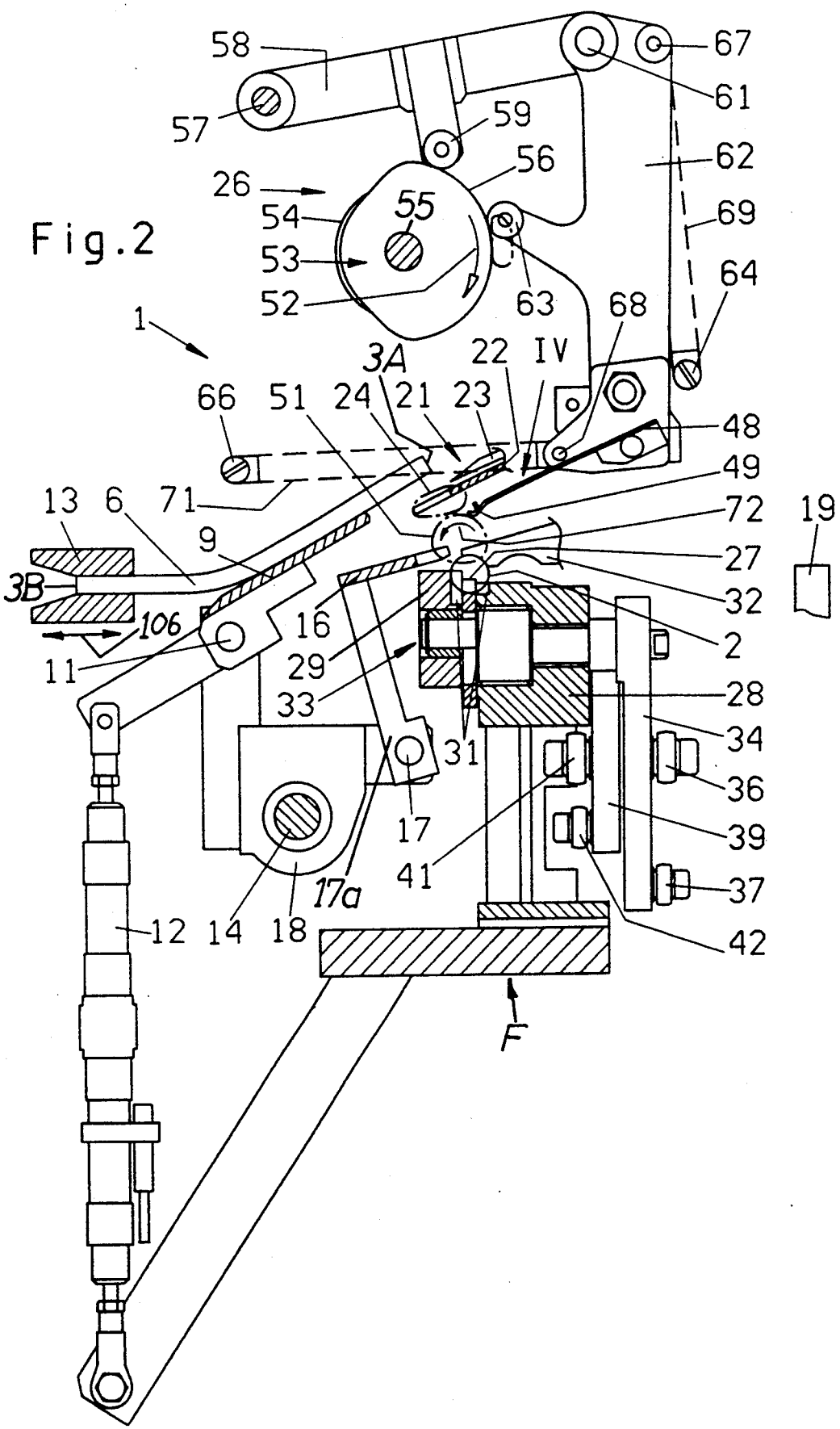
FIG. 2 is an enlarged fragmentary transverse vertical sectional view substantially as seen in the direction of arrows from the line II—II in FIG. 1 and further shows certain details of the upper portion of the improved apparatus.

The apparatus which is shown in FIGS. 1 to 8 is utilized to assemble successive stacks 6 of overlapping paper sheets, plastic sheets or other types of sheets with rows of spaced apart aligned circular binders 2 (one such row is shown in FIG. 1) at an assembling station 1 best shown in FIG. 2. The illustrated circular binders 2 have disc-shaped central portions 2*b* (FIG. 8) surrounded by rims 2*a* so that the peripheral portion of each binder has a substantially T-shaped cross-sectional outline. The peripheral portion of each binder 2 in the row of binders at the station 1 must be introduced into a discrete T-shaped recess or cutout 4 in one (3A) of two elongated spaced apart parallel marginal zones 3A, 3B (FIG. 2) of each sheet 3 forming part of a stack 6. The recesses 4 are equidistant from each other (the same as the binders 2 of the row of binders at the assembling station 1) and are surrounded by deformable portions 3*a* of the respective sheet. Such deformable portions 3*a* yield temporarily when a sheet 3 is caused to enter the assembling station 1 for the purpose of ensuring that each recess 4 in its marginal zone 3A receives a portion of a discrete binder 2 in a manner as clearly shown in FIG. 8, namely so that the peripheral portion of the binder at least substantially fills the corresponding (complementary) recess 4. Each recess 4 has an enlarged portion remote from the marginal zone 3A and a narrower or neck portion extending from the enlarged portion all the way to the marginal portion. Such recesses can be formed by stamping or in any other suitable way not forming part of the present invention.

Figure 6:
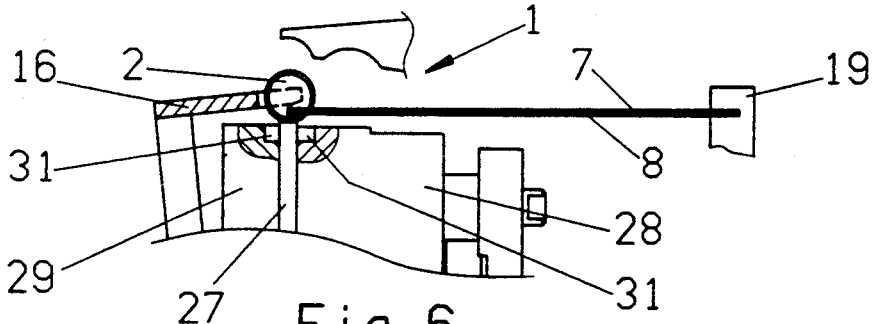
FIG. 6 illustrates another detail in the structure of FIG. 2, and more specifically a device for delivering elongated rows of binders to the assembling station.

The means for supplying successive stacks 6 of overlapping sheets 3 to the assembling station 1 comprises tongs 13 (FIG. 2) movable toward and away from the station 1 in directions (arrow 106) substantially at right angles to the marginal zone 3A, 3B of the sheets 3. The rows of binders 2 are delivered to the station 1 by a toothed comb-like member 16 which is movable back and forth (arrow 116 in FIG. 1) in the longitudinal direction of such rows and in parallelism with the marginal zones 3A, 3B of a stack 6 which is held at the station 1 by the jaws of the tongs 13. The rows of binders 2 are preferably assembled with at least one panel (FIG. 6 shows two panels 7 and 8) which is held and guided by a pusher 19 (FIGS. 2 and 6). The panels 7 and 8 can constitute the top and bottom covers of the finished product (e.g., a steno pad), and one marginal zone of each panel is provided with a row of recesses similar to or identical with recesses 4 of the sheets 3. The thickness of each panel 7 and/or 8 can be several times the thickness of a sheet 6. At least one of the panels 7, 8 can be made of two or more overlapping sheets 3 which are bonded to each other.

The tongs 13 of the means for supplying successive stacks 6 to the assembling station 1 cooperate with a platform 9 whose orientation (inclination) relative to the tongs can be changed by a fluid-operated motor 12 having a cylinder affixed to a stationary part of the frame F of the apparatus and a piston rod articulately connected to the platform so as to pivot the platform about the axis of the horizontal shaft 11. The platform 9 is inclined upwardly and away from the tongs 13 when a fresh stack 6 is being supplied to the assembling station 1, and the inclination of the platform 9 is thereupon reduced (see FIG. 7) during attachment of portions (smaller stacks) of a stack 6 to the row of binders 2 which are held in discrete sockets 31 of a composite support including a fixed first support 28 and a mobile second support 29 on the frame F.

Figure 7:
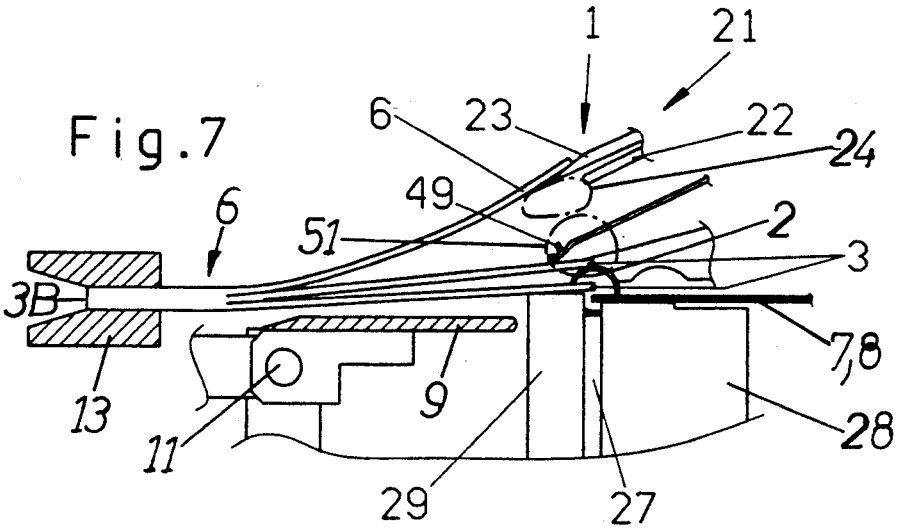
FIG. 7 illustrates another detail in the structure of FIG. 2, namely the mechanism for breaking up successive stacks of overlapping sheets into smaller stacks.
Figure 5:
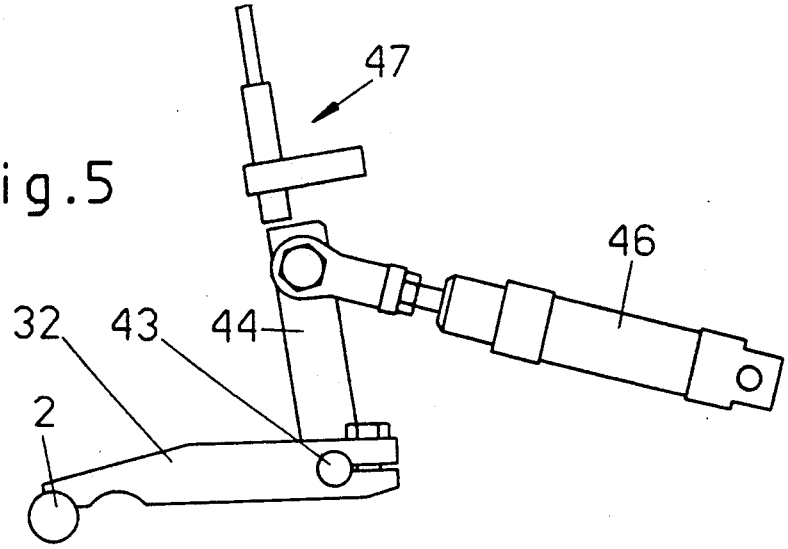
FIG. 5 is an enlarged view of a detail in the structure of FIG. 2 and further shows a mechanism for moving a device which is used to bias the binders of a row of aligned binders into discrete sockets provided in stationary and mobile supports.

The apparatus further comprises a mechanism 21 which serves to break up a stack 6, whose marginal zone 3B is grasped by the tongs 13, into a succession of smaller stacks (e.g., into discrete sheets 3) which are attached to the rims 2*a* of binders 2 in the sockets 31. The sockets 31 receive the respective binders 2 of a straight row of equidistant binders which were delivered by the comb-like member 16 in one of the directions indicated by the arrow 116, and the panels 7, 8 are supported in part by the pusher 19 (which is connected to the carriage 18 or to the member 16 in a manner not shown in the drawings) and rest on the stationary support 28 (FIG. 7). The comblike member 16 is movable along a fixed guide 14 in the form of a horizontal shaft (FIG. 2) mounted in the frame F and directly supporting a reciprocable carriage 18 having a horizontal pivot member 17 for the arms 17*a* which are affixed to the member 16. The shaft 14 extends at right angles to the plane of FIG. 2. The teeth or prongs of the member 16 alternate with the sockets 31, i.e., with the binders 2 of the row of binders 2 at the assembling station 1. The purpose of the pusher 19 is to prevent the panels 7, 8 (and hence the binders 2) from changing their orientation during advancement toward as well as during the interval of dwell at the assembling station 1 and also to prevent a change of orientation of the finished stationery product which is transported (by the member 16) away from the station 1 in the other of the two directions indicated by the double-headed arrow 116.

The mechanism 21 for breaking up a stack 6 at the station 1 (e.g., by singularizing the sheets 3 of such stack) comprises a plate-like holder 22 at a level below a mobile subdividing tool 23 known as sword. Reference may be had, for example, to commonly owned U.S. Pat. No. 4,662,816 granted May 5, 1987 to Paul Fabrig for "Method of breaking up stacks of paper sheets or the like" and/or to commonly owned U.S. Pat. No. 4,313,703 granted Feb. 2, 1982 to Paul Fabrig for "Apparatus for breaking up stacks of paper sheets or the like". The disclosures of these patents are incorporated herein by reference. The parts 22, 23 of the mechanism 21 are movable relative to each other in the following ways: The tool 23 can penetrate into that edge face of a stack 6 which includes the marginal zones 3A, and the tip of the holder 22 is movable along an endless path 24 (FIGS. 2 and 7). The means for moving the tool 23 and the holder 22 can be the type described in the patents to Fabrig or analogous to an orbiting means 26 (FIGS. 2 and 4) for the means (to be described hereinafter) for moving the deformable portions 3*a* of sheets 3 against the rims 2*a* of the adjacent binders 2.

The main components of the improved apparatus at the assembling station 1 include the means (including the member 16) for delivering binders 2 into and for temporarily retaining the binders in the sockets 31, and the aforementioned means for moving the deformable portions 3*a* of the sheets 3 of a stack 6 against the rims 2*a* of binders 2 in the sockets 31. The retaining means includes the aforementioned supports 28, 29 and an elongated stop 27 which is installed between the two supports and is movable up and down by increments of predetermined magnitude. Each socket 31 has a first portion (e.g., one half) in the first support 28 and a second portion (e.g., the other half) in the second support 29. Once the binders 2 are introduced into the respective sockets 31, they are biased from above against the adjacent portions of the stop 27 by the working ends of a mobile biasing device 32.

Figure 3:
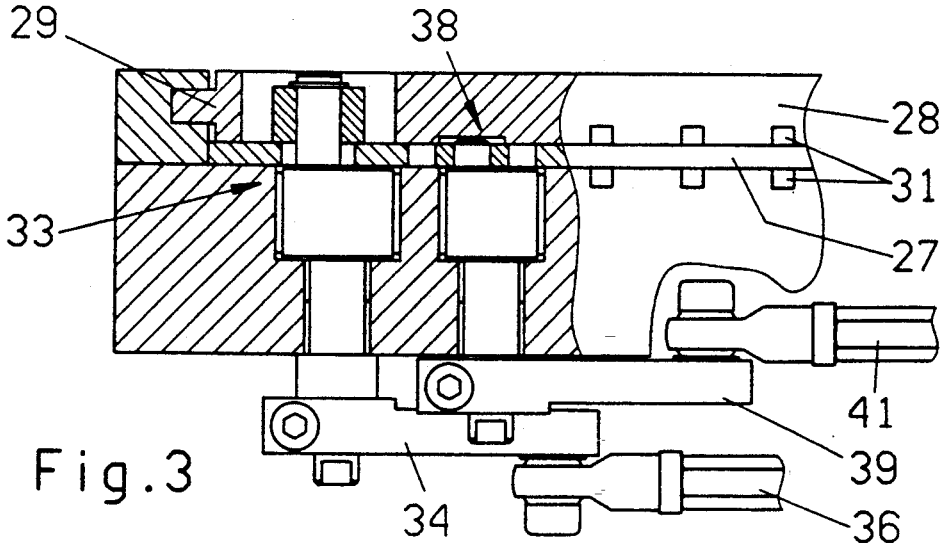
FIG. 3 is an enlarged fragmentary horizontal sectional view substantially as seen in the direction of arrows from the line III—III in FIG. 1.

The means for moving the support 29 relative to the support 28 comprises eccentrics 33 (FIGS. 1, 2 and 3)

mounted on parallel levers 34 which are coupled to each other by a connecting rod 36. One of the levers 34 receives motion from a reciprocable piston rod 37 forming part of a fluid-operated motor.

The means for moving the stop 27 relative to the support 28 comprises two eccentrics 38 connected with parallel levers 39 which are coupled to each other by a connecting rod 49. One of the levers 39 can be pivoted back and forth by the piston rod 42 of a fluid-operated motor.

The means for biasing the binders 2 against the surfaces bounding the respective sockets 31 comprises the aforementioned biasing device 32 and means (see particularly FIG. 5) for pivoting the device 32. Such pivoting means comprises a fixed shaft 43 rotatable in the frame F, a link 44 which is rigid with the shaft 43 and a fluid-operated motor 46 having a cylinder which is held against axial movement and a piston rod articulately connected to the link 44. The character 47 denotes in FIG. 5 a sensor which generates a signal for the follow-up controls of the apparatus. Such controls ensure that various steps involving the attachment of sheets 3 to the respective rows of binders 2 are carried out in a predetermined sequence as will be described below.

Figure 4:
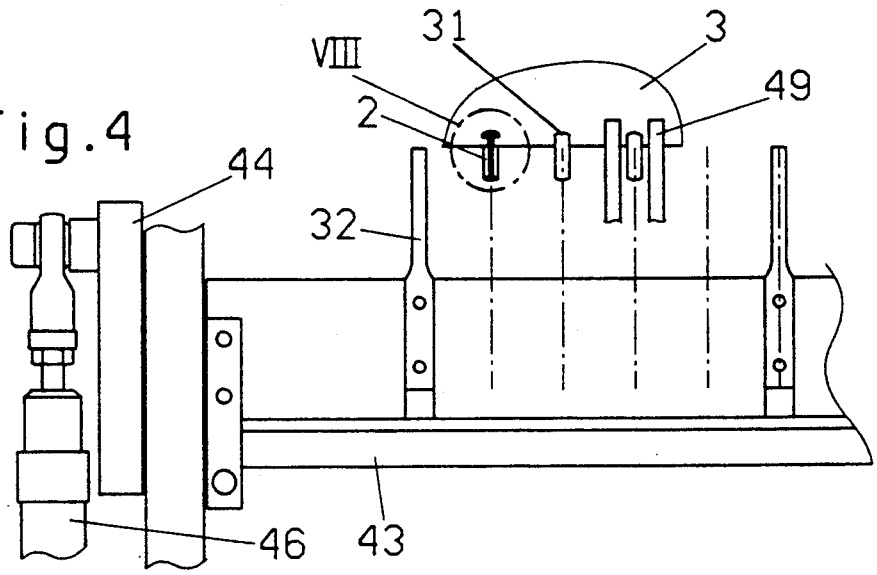
FIG. 4 is a fragmentary plan view substantially as seen in the direction of arrow IV in FIG. 2.
Figure 8:
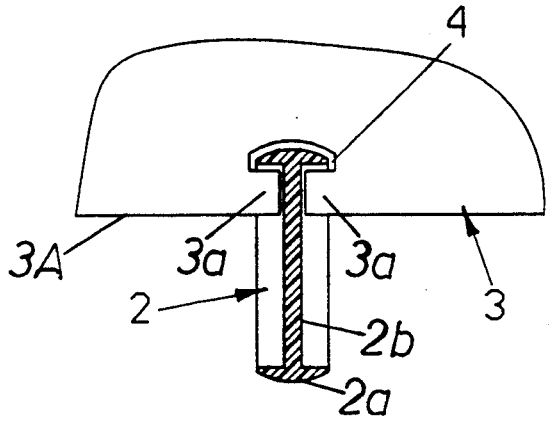
FIG. 8 is an enlarged view of the detail within the phantom-line circle VIII in FIG. 4.

The means for moving the deformable portions 3*a* of the sheets 3 against the adjacent binders 2 at the assembling station 1 comprises an elongated carrier 48 for a set of deforming units or elements 49 having end portions or tips which can be caused to bear against and to deform the adjacent deformable portions 3*a* of sheets 3 which are to be affixed to the binders 2 of a row of binders at the assembling station 1 (see FIG. 4). The tops of the deforming elements 49 are movable along endless paths 51. The drive means 26 for orbiting the sheet engaging portions or tips of the deforming elements 49 along the paths 51 is shown in FIG. 2 and comprises a composite cam 53 rotatable in the direction of arrow 52 and comprising two disc cams 54, 56 rotatable as a unit about the axis of a fixedly mounted shaft 55. The means for rotating the cams 54, 56 through the medium of the shaft 55 and/or otherwise is not shown in the drawings. The peripheral surface of the cam 54 is tracked by a roller follower 59 which is thereby movable up and down, and the peripheral surface of the cam 56 is tracked by a roller follower 63 which is thereby caused to move to the left and to the right (as viewed in FIG. 2). The follower 59 is mounted on a lever 58 which is pivotable about the fixed axis of a horizontal shaft 57 extending in parallelism with the shaft 55, and the free end of the lever 58 carries a horizontal pintle 61 for a downwardly extending lever 62 which carries the follower 63. The follower 59 is biased against the cam 54 by a coil spring 69 one end of which is affixed to a pin 67 on the lever 58 and the other end of which is affixed to a pin 64 in or on the frame F. The follower 63 is biased against the cam 56 by a coil spring 71 one end of which is affixed to a pin 68 on the lever 62 and the other end of which is affixed to a pin 66 in the frame F.

The mode of operation of the improved apparatus is as follows:

The comb-like member 16 is assumed to carry a set of uniformly spaced apart identical binders 2 which are aligned with each other so that they form a straight row and each of which is aligned with and located at a level slightly above the row of sockets 31 in the supports 28 and 29. The binders 2 are already assembled with the panels 7, 8 whose free ends are held by the pusher 19. The latter is connected with the carriage 18 for the member 16. The member 16 has delivered the straight row of binders 2 in one of the directions indicated by the arrow 116 shown in FIG. 1. The mobile second support 29 is maintained in a lowered position so that its upper side is located at or below the level of the upper side of the first support 28 (see FIG. 6). The stop 27 is shown in raised position in which its upper side is located at or above the level of the upper sides of the supports 28 and 29. Such positioning of the supports 28, 29 and of the stop 27 ensures unimpeded introduction of the row of binders 2 into the assembling station 1, i.e., to positions in which each of the binders 2 is in register with one of the sockets 31.

The next step involves pivoting of the comb-like member 16 from the position of FIG. 6 toward the position of FIG. 2 so that the member 16 is free to move in the other of the two directions indicated by the arrow 116 to a starting position in which it is ready to accept and to advance to the assembling station 1 a fresh set or row of binders 2.

The stop 27 is thereupon lowered from the position of FIG. 6 to its lower end position which is shown in FIG. 2. At the same time, or shortly before or thereafter, the mobile support 29 is lifted to the position of FIG. 2 in which its upper side is located at or close to the level of the common axis of the row of binders 2 at the assembling station 1. Each of the binders 2 is then received in one of the sockets 31 in such a way that the neighboring binders are equidistant from each other and are ready to have their rims 2*a* engaged by the deformable portions 3*a* of sheets 3 forming part of a stack 6 which is to be combined with the row of binders.

The tips of the biasing device 32 descend as soon as the binders 2 are properly received in their sockets 31 so that the tips of the device 32 cooperate with the surfaces bounding the sockets 31 to hold the binders against any shifting during attachment of a series of sheets 3, i.e., of a complete stack 6. Thus, each binder 2 is reliably clamped between the tip of the respective device 32 and the adjacent portion of the upper side of the stop 27.

The tongs 13 advance a stack 6 of overlapping sheets 3 to the position of FIG. 7 in which the stack is ready to be subdivided into smaller stacks (e.g., into discrete sheets 3) by the mechanism 21 including the holder 22 and the sword 23. Prior to being subdivided or singularized, the right-hand marginal portion of the freshly delivered stack 6 rests on the platform 9 (FIG. 2) which is then inclined upwardly and away from the tongs 13. The motor 12 thereupon pivots the platform 9 in a clockwise direction (as viewed in FIG. 2) so that the right-hand marginal portion of the stack 6 comes to rest on the left-hand portion of the holder 22 which has been advanced along the endless path 24 so that it extends beyond the edge of the sword 23. The sword 23 is thereupon caused to penetrate into the stack 6 and to separate therefrom a smaller stack including one or more sheets 3 which rest on the holder 22. The remainder of the stack 6 rests on the sword 23. The holder 22 then retreats in a direction away from the platform 9 so that it releases the freshly separated sheet or sheets 3 beneath the sword 23 and such sheet or sheets 3 are engaged by the tips of the deforming elements 49 which are caused to press the deformable portions 3*a* of the single sheet 3 or of the uppermost sheet 3 on the row of binders 2 in the sockets 31 against the rims 2*a* of the adjacent binders so that the rims enter the respective recesses 4 and the attachment of the sheet or sheets 3 to the row of binders 2 is completed. The retracted position of the holder 22 is shown in FIG. 7 which further shows how the sword 23 supports from below the sheets 3 of the remainder of the stack 6 and how the tips of the elements 49 urge one or more sheets 3 downwardly to cause the rims 2a of the binders 2 to penetrate into the adjacent recesses 4. The tongs 13 continue to grasp the left-hand marginal portion of the entire stack 6 which is in the process of having its sheets attached to the binders 2 in the sockets 31.

The arrow 72 denotes in FIG. 2 the direction in which the carrier 48 causes the tips of the deforming elements 49 to move along an endless (e.g., circular) path to thus ensure that one or more sheets 3 forming part of the stack 6 which is being held by the tongs 13 are engaged by the rims 2a of the row of binders 2 at the assembling station 1. Each such orbital movement of the tips of the elements 49 involves temporary deformation but no tearing and/or permanent folding of the sheet portions 3a at the recesses 4. The innate elasticity of the sheet portions 3a suffices that they resile and reassume the position of coplanarity with the major portions of the respective sheets 3 as soon as the rims 2a have properly entered and at least substantially fill the respective recesses 4.

The mobile support 29 is thereupon lowered by an increment corresponding to the thickness of a stack portion (e.g., one sheet but preferably two or more overlapping sheets) which has been attached to the rims 2a of the binders 2 in the sockets 31. Such incremental lowering of the mobile support 29 is desirable and advantageous because it ensures that the circumstances for attachment of the next smaller stack of sheets 3 to the rims 2a of the binders 2 in the sockets 31 are identical with those which prevailed during attachment of the preceding smaller stack. Intermittent lifting of the stop 27 during attachment of a stack 6 to the binders 2 in the sockets 31 is carried out for the same reason, i.e., to ensure that the circumstances are identical irrespective of whether the binders 2 are being connected with the topmost sheets, with the median sheets or with the lowermost sheets of a stack 6. For example, a reasonably thick stack 6 can be subdivided into as many as twelve smaller stacks which are individually attached to the rims 2a of the binders 2 in the sockets 31. The application of the last smaller stack results in completion of a pad or an analogous stationery product which is thereupon expelled from the station 1, preferably by the comb-like member 16 which is in the process of delivering a fresh row of binders 2 toward positions of register with the sockets 31. The tongs 13 are disengaged from the adjacent marginal portion of the finished or assembled stationery product and are then ready to accept and supply a next stack 6 toward the assembling station 1. All of the mobile parts are retracted to their starting positions before the procedure of connecting the next stack 6 with a fresh row of binders 2 at the assembling station 1 begins.

An important advantage of the improved method and apparatus is that the deformable portions 3a of the sheets 3, as well as the entire sheets 3 and the entire stacks 6 of overlapping or superimposed sheets are treated gently. Moreover, the operation of the apparatus can be automated to any desired extent so that the assembly of a stack 6 with a row of binders 2 can be completed within a surprisingly short interval of time, i.e., the output of the apparatus can be raised practically at will without risking damage to the sheets 3 and/or otherwise affecting the quality of the ultimate products.

The supports 28, 29 cooperate with the stop 27 and with the biasing means including the tips of the device 32 to ensure that each and every binder 2 of a row of binders at the assembling station 1 is form-lockingly as well as force-lockingly held preparatory to as well as during attachment of a stack 6 of sheets 3 thereto. This further reduces the likelihood of tearing, folding and/or otherwise damaging or defacing the deformable portions 3a of the sheets 3 during attachment to the rims 2a of the binders 2 at the station 1.

The feature that the binders 2 of a full row of binders are attached to the panel 7 and/or 8 prior to advancement to the assembling station 1 even further reduces the likelihood of misalignment of the binders at the time the deforming means 48, 49 proceeds to attach successive sheets or smaller stacks of sheets to the binders in the sockets 31.

It will be appreciated that the rims 2a and the recesses 4 need not have a T-shaped outline. For example, the binders can be provided with rims having substantially L-shaped cross-sectional outlines to fit into L-shaped recesses in one marginal portion of each sheet.

Furthermore, and even though the illustrated apparatus is designed to deliver singularized sheets 3 or singularized groups (smaller stacks) of sheets from above (i.e., the breaking up mechanism 21 is located at a level above the sockets 31), it is also possible to modify the apparatus in such a way that the binders 2 and/or analogous binders and/or singularized sheets or singularized groups of sheets are fed to the assembling station 1 from below or sideways.

Furthermore, and even though it is within the purview of the invention to intermittently lift the stop 27 and/or to intermittently lower the mobile support 29 upon each second or third attachment of a singularized sheet or a singularized group of sheets to the binders 2 in the sockets 31, it is presently preferred to carry out such intermittent lowering and lifting after each and every attachment of one or more sheets 3. The lifting of the stop 27 and/or the lowering of the mobile support 29 need not entail a displacement of an entire singularized sheet 3 or of an entire singularized group of sheets 3, as long as the circumstances at the assembling station 1 proper remain at least substantially unchanged during attachment of an entire stack 6 to the binders 2 in the sockets 31.

Still further, it is possible to mount the deforming elements 49 in such a way that their tips perform movements along a path other than an endless path 51. However, the illustrated movements along the path 51 are preferred at this time because they cause the tips of the elements 49 to gently slide along the upper sides of the deformable portions 3a of sheets 3 to thus even further reduce the likelihood of damage to and/or defacing of the sheets during attachment to a row of binders 2 at the station 1.

The feature that portions of the sockets 31 extend into two supports 28, 29 at least one of which is movable relative to the other support renders it possible to introduce the binders 2 into the sockets 31 in a highly predictable manner. This enhances the quality of the ultimate products since the likelihood that the deformable portions 3a of the sheets 3 would tear and/or undergo other damage is greatly increased if the positions of the binders 2 at the station 1 deviate, even so slightly, from optimum positions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of assembling stacks of overlapping sheets, each having a plurality of marginal recesses and deformable sheet portions at the recesses, with binders having profiles substantially complementary to and receivable in the recesses, comprising the steps of positioning a series of spaced apart and aligned binders at an assembling station; and moving the deformable sheet portions against the positioned binders so that each binder deforms a discrete portion of each sheet and enters the respective recess.

2. The method of claim 1, wherein said moving step includes advancing the deformable portions of successive sheets of a stack from a higher level above to a lower level of engagement with the binders at said assembling station.

3. The method of claim 1, wherein said positioning step includes force- and form-lockingly holding the spaced apart and aligned binders at said assembling station in the course of said moving step.

4. The method of claim 3, further comprising the steps of connecting the binders of said series with at least one panel to thus locate the binders in a row at predetermined distances from each other, and thereupon advancing the at least one panel and the row of binders thereon to said assembling station.

5. The method of claim 1, further comprising the steps of providing the overlapping sheets of the stacks with substantially T-shaped recesses and providing each binder with a substantially circular rim having a substantially T-shaped cross-sectional outline.

6. The method of claim 1, further comprising the steps of locating a stack of overlapping sheets adjacent said assembling station and subdividing the thus located stack into a succession of smaller stacks each of which contains at least one sheet, said moving step including transferring the deformable sheet portions of successive smaller stacks of said succession against the positioned binders at said assembling station.

7. The method of claim 6, wherein said locating step comprises maintaining the stack of overlapping sheets above said assembling station and said transferring step comprises shifting the deformable sheet portions of successive smaller stacks of said succession downwardly against the positioned binders at said assembling station.

8. The method of claim 7, further comprising the step of changing the level of the sheets upon completion of at least one of said shifting steps.

9. The method of claim 8, wherein said level changing step comprises lowering the entire smaller stack or stacks shifted upon completion of said at least one shifting step.

10. The method of claim 6, further comprising the step of raising the positioned binders at said assembling station upon completed transfer of at least one of said succession of smaller stacks.

11. The method of claim 1, further comprising the steps of connecting the binders of said series with at least one panel to thus locate the binders in a straight elongated row at predetermined distances from each other, and thereupon advancing the at least one panel to said assembling station in the longitudinal direction of said elongated row.

12. The method of claim 1 of assembling binders with stacks of overlapping sheets having spaced parallel first and second marginal zones with recesses provided in the first marginal zones, further comprising the step of delivering a series of stacks to said assembling station including conveying the stacks substantially at right angles to the marginal zones.

13. The method of claim 12, further comprising the step of clamping the second marginal zones of successive stacks of said series of stacks in the course of said conveying and moving steps.

14. Apparatus for assembling stacks of overlapping sheets, each having a plurality of marginal recesses and deformable sheet portions at the recesses, with binders having profiles substantially complementary to and receivable in the recesses, comprising means for positioning a series of spaced apart and aligned binders at an assembling station; and means for moving the deformable sheet portions of a stack of overlapping sheets against the positioned binders at said station so that each binder deforms a discrete portion of each sheet and enters the respective recess.

15. The apparatus of claim 14, wherein said positioning means comprises a row of spaced apart positioning units at said station and said moving means comprises a plurality of deforming units each adjacent one of said positioning units.

16. The apparatus of claim 15, wherein said deforming units alternate with said positioning units.

17. The apparatus of claim 14, wherein said moving means comprises an elongated carrier and a plurality of deforming elements provided on said carrier.

18. The apparatus of claim 17, wherein said deforming elements have sheet engaging portions and said moving means further comprises means for orbiting said sheet engaging portions along endless paths.

19. The apparatus of claim 14 for assembling stacks of sheets with circular binders, wherein said positioning means has a row of sockets for discrete binders, a stop for the binders in said sockets, and means for biasing the binders in said sockets against said stop.

20. The apparatus of claim 19, wherein said positioning means further comprises a stationary first support and a mobile second support at said station, each of said sockets having a first portion in said first support and a second portion in said second support.

21. The apparatus of claim 20, further comprising means for moving said second support relative to said first support through increments of predetermined length.

22. The apparatus of claim 20 for assembling stacks of overlapping sheets with rows of binders wherein each row of binders is connected with at least one panel, said first support having means for locating the at least one panel at said station while the binders of the respective row are disposed in said sockets.

23. The apparatus of claim 20, wherein said stop is located between said first and second supports, and further comprising means for moving said stop relative to said first support.

24. The apparatus of claim 23, wherein said sockets are disposed above said stop and said means for moving said stop includes means for moving the stop up and down.

25. The apparatus of claim 14, further comprising means for breaking up successive stacks of a series of stacks into a succession of smaller stacks at said station, including means for delivering successive smaller stacks of each succession of smaller stacks to said moving means.

26. The apparatus of claim 25, wherein said delivering means comprises a holder for discrete smaller stacks and means for moving said holder along an endless path between a first position in which the holder accepts a smaller stack and a second position in which the holder presents the smaller stack to said moving means.

27. The apparatus of claim 26, wherein said means for breaking up successive stacks further comprises a subdividing tool and means for moving said tool into a stack at said station to separate a smaller stack therefrom.

28. The apparatus of claim 27, wherein said tool comprises a sword.

29. The apparatus of claim 26, wherein said means for breaking up successive stacks comprises a device for supplying successive stacks to said station, a platform located at said station to support from below a stack which is supplied by said device, and means for changing the orientation of said platform relative to said device.

30. The apparatus of claim 14, wherein said positioning means comprises means for delivering elongated rows of binders to said station longitudinally of the rows.

* * * * *